United States Patent [19]

Caporali et al.

[11] Patent Number: 4,992,771

[45] Date of Patent: Feb. 12, 1991

[54] CHIP RESISTOR AND METHOD OF MANUFACTURING A CHIP RESISTOR

[75] Inventors: Didier Y. F. Caporali; Frans L. A. Geerinckx, both of Brussels, Belgium

[73] Assignee: U.S. Philips Corporation, New York, N.Y.

[21] Appl. No.: 333,483

[22] Filed: Apr. 5, 1989

[30] Foreign Application Priority Data

Apr. 5, 1988 [NL] Netherlands ..... 8800853

[51] Int. Cl.[5] ..... H01C 7/10

[52] U.S. Cl. ..... 338/22 R

[58] Field of Search ..... 338/22 R, 22 SD, 20, 338/21, 203

[56] References Cited

U.S. PATENT DOCUMENTS 4,706,060 11/1987 May ..... 338/332 X

FOREIGN PATENT DOCUMENTS 0229286 7/1987 European Pat. Off. .

3148778 12/1982 Fed. Rep. of Germany .

1188213 4/1970 United Kingdom .

*Primary Examiner*—George H. Miller, Jr.

*Assistant Examiner*—Marvin M. Lateef

*Attorney, Agent, or Firm*—Norman N. Spain

[57] ABSTRACT

A chip resistor having a cuboid resistor body 1 of a ceramic material and solderable, metal current-supply strips 8 and 9 at a first pair of opposite side faces of the resistor body, can readily and accurately be manufactured so that it has a small resistance value, in that electrically insulating strips 6 and 7 are present between the solderable metal strips and the resistor body, and in that a second pair of opposing side faces of the resistor body is covered with electrically conductive layers 2 and 3, which layers are partly covered with electrically insulating layers 4 and 5, in such a way that each of the solderable metal strips 8 and 9 electrically conductively contacts one of the electrically conductive layers 2 and 3.

2 Claims, 1 Drawing Sheet

CHIP RESISTOR AND METHOD OF MANUFACTURING A CHIP RESISTOR

BACKGROUND OF THE INVENTION

The invention relates to a chip resistor comprising a cuboid resistor body of ceramic material and solderable, metal, current-supply strips at a first pair of opposite side faces of the resistor body.

The invention also relates to a method of manufacturing a chip resistor, in which a cuboid resistor body is provided at two opposite side faces with metal, current-supply strips.

The invention can particularly suitably be applied to resistors having no lead wires, a semi-conductive ceramic material being used as a resistance material, in particular materials having a negative (NTC) or a high positive (PTC) temperature coefficient of electrical resistance.

U.S. Pat. No. 3,027,529 describes a PTC resistor, in which a resistor body in the form of a cylinder or a disc is used. The electric connections consist of metal caps which are fitted around the ends of the cylinder, or of lead wires which are soldered to the flat sides of the disc.

In the manufacture of electric components having no lead wires, the dimensions of which should be as small as possible, and which should be manufactured in large numbers at low costs, the application of caps is undesired in many cases. According to an alternative method, contact faces for the supply of electric current are manufactured by means of sputtering, metal spray or vapour deposition, but then it is not easy to manufacture contact faces which extend around the edges of the component.

Components having no lead wires, which are preferably cuboid, should at each end be provided with terminals on three faces owing to the various soldering techniques used for mounting on a printed circuit board. In the case of wave soldering, a component is temporarily fixed to a printed circuit board by means of an adhesive, after which a solder wave is led over the surface of the board. This technique requires the presence of terminals at the side faces of the electric component. In a vapour soldering process, drops of a solder paste are placed on the printed circuit board, after which the electric components are provided and the assembly is heated in a vapour, the solder paste being converted into a conductive contact material. This technique requires the presence of terminals on the lower side of the electric component which lies against the printed circuit board. For reasons of symmetry there is preferably also a terminal on the upper side so as to render an additional check superfluous when the electric component is mounted on the printed circuit board.

The non-prepublished Netherlands Patent Application NL-A-8800156 in the name of Applicants relates to a chip resistor as described in the opening paragraph, in which a second pair of opposite side faces is covered completely with electrically insulating layers, and in which the solderable metal strips are directly connected, both mechanically and electrically conductively, to the resistor body. The chip resistor is manufactured from a plate of ceramic resistance material which is divided into strips and which strips are subsequently divided into cuboids.

In chip resistors the spacing between the contact faces is preferably as large as possible with a view to the positional accuracy on a printed circuit board. During operation of the chip resistor the electric current passes through a block of resistance material of small cross-sectional area over a substantial length. For this reason, this construction is particularly suitable for the manufacture of a chip resistor having a large resistance value. It is not easy to manufacture a chip resistor having a relatively small resistance value with sufficient accuracy. The resistors can be measured and sorted after the manufacture, but in the case of a tolerance of, for example, less than 1% the number of rejects will be high.

SUMMARY OF THE INVENTION

It is an object of the invention to provide a chip resistor and a method of manufacturing a chip resistor, which allows a chip resistor having a small resistance value to be manufactured very accurately. In this respect, it is an object to provide a simple method with a high yield for the manufacture of such chip resistors.

This object is achieved in accordance with the invention by a chip resistor as described in the opening paragraph, which chip resistor is characterized in that electrically insulating strips are present between the solderable metal strips and the resistor body, and in that a second pair of opposing side faces of the resistor body is covered with electrically conductive layers, which layers are partly covered with electrically insulating layers in such a way that each of the solderable metal strips is in electrically conductive contact with one of the electrically conductive layers, the electrically insulating layers being made of a ceramic material.

An additional advantage of the chip resistor in accordance with the invention is the presence of insulating layers on the outer surfaces. Even if no additional envelope is provided, no electrically conductive connection can be formed with underlying conductor tracks if the chip resistor is placed on a printed circuit board.

The object of providing a readily conceivable and efficacious method of manufacturing a chip resistor is achieved in accordance with the invention by a method which comprises the following steps:

a plate of ceramic resistance material is provided on both sides with electrically conductive layers, both sides of the plate are provided with electrically insulating layers according to a pattern, the plate is divided into strips, the strips are provided on the large uninsulated sides with electrically insulating strips, the strips are provided with solderable metal strips on top of the electrically insulating strips, each of the metal strips being electrically conductively connected to one of the electrically conductive layers, the strips are divided into cuboids.

In U.S. Pat. No. 4,529,960 a description is given of a chip resistor comprising a thin resistance layer on a substrate. Metal layers are provided on two opposing edges of the resistance layer. Metal strips are provided on the side faces of the substrate, which strips extend around the edges in order to contact the metal layers and which can suitably be soldered at several sides. The chip resistor is manufactured from a non-conductive ceramic plate which is divided into strips and which strips are subsequently divided into cuboids.

The invention will now be explained in more detail by means of an exemplary embodiment and with reference to the drawings.

DETAILED DESCRIPTION OF THE INVENTION

Exanple

Figure 1A:
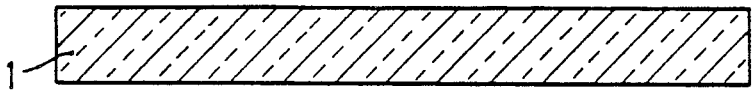
FIGS. 1*a* to 1*f* are sectional views of a number of steps during the method of manufacturing a chip resistor according to the invention.

According to the example, a ceramic plate 1, see FIG. 1*a*, is used which is made of an NTC resistance material. The thickness of the plate corresponds to the thickness of the chip resistors to be manufactured and amounts to, for example, 0.5 to 0.8 mm.

Figure 1B:
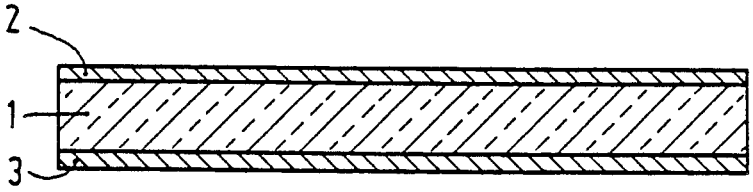

The ceramic plate is covered on both sides with conductive metal layers 2 and 3, for example, by immersing it in a silver-palladium paste consisting of a mixture of finely dispersed Ag and Pd (weight ratio 70/30) in a cellulose-acetate binder. The metal paste is fired, thereby forming the conductive metal layers 2 and 3, see FIG. 1*b*.

By means of a mask the ceramic plate is provided on both sides with layers of a zirconium oxide paste according to a pattern, said paste containing 425 g of $ZrO_2$ per $dm^3$ of water. The plate is dried in air at 125° C. for 30 minutes. Subsequently, white enamel layers 4 and 5 are formed on both surfaces of the ceramic plate by firing in air at 900° C. for 1 hour, see FIG. 1*c*.

Figure 1C:
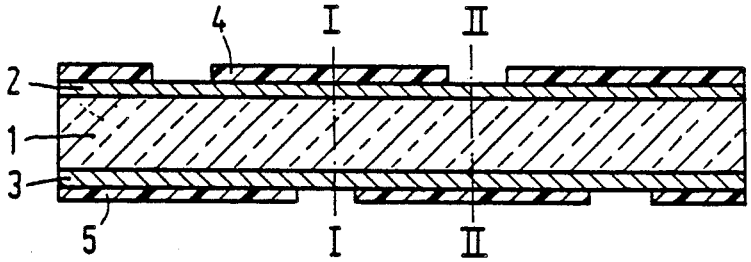
Figure 1D:
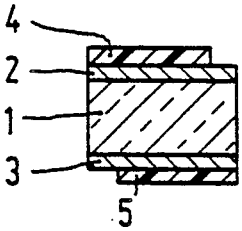

The ceramic plate is cut into strips, see the cuts I—I and II—II in FIG. 1*c*, the width of the strips corresponding to the length of the chip resistors to be manufactured, see FIG. 1*d*. The width of the strips amounts to, for example, 1.0 to 3.2 mm.

Figure 1E:
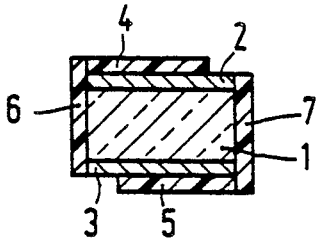

Subsequently, electrically insulating layers 6 and 7 are provided by immersing the strips in a zirconium oxide paste, of the above-stated composition, which is dried and fired in the same manner as in the case of the manufacture of the layers 4 and 5, see FIG. 1*e*.

Figure 1F:
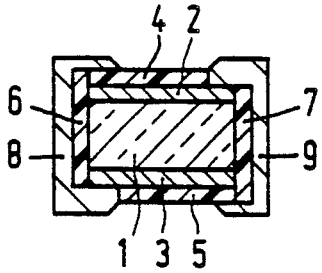

Subsequently, metal strips 8 and 9 are provided by means of a silver-palladium paste having the above-stated composition, see FIG. 1*f*.

Finally, the strips are sawn into cuboids, the width of the chip resistor formed codetermining the resistance value attained and amounting to, for example, 0.8 to 1.6 mm. If desired, the metal strips 8 and 9 can also be provided with solder-resistant metal layers, for example, consisting of layers of nickel and lead-tin which are provided by means of electrode position. Moreover, the chip resistor can be provided with a protective layer or envelope of, for example, a synthetic resin.

Instead of cutting, the strips and cuboids may also be manufactured by means of scribing and breaking or by means of a laser cutting device. If scribing is applied, care should be taken that the slots formed are not filled when a paste is applied. To achieve this, the paste can be applied, for example, via a roller.

The method described herein permits accurate resistors to be manufactured, with, in particular, low resistance values being possible.

We claim:

1. A chip resistor comprising a cuboid resistor body 1 of ceramic material and solderable, metal, current-supply strips 8 and 9 located at a first pair of opposite side faces of the resistor body, characterized in that electrically insulating strips 6 and 7 are present between the solderable metal strips 8 and 9 and the resistor body, and in that a second pair of opposing side faces of the resistor body is covered with electrically conductive layers 2 and 3, which layers are partly covered with electrically insulating layers 4 and 5, in such a way that each of the solderable metal strips 8 and 9 is electrically conductively connected to one of the electrically conductive layers 2 and 3, the electrically insulating layers being made of a ceramic material.

2. A method of manufacturing a chip resistor, in which a cuboid resistor body is provided at two opposing side faces with metal current-supply strips, characterized in that the method comprises the following steps:

a plate 1 of a ceramic resistance material is provided on both sides with electrically conductive layers 2 and 3, layers 2 and 3 are provided with electrically insulating layers 4 and 5 according to a pattern, the plate is divided into strips each strip having two large uninsulated sides, the strips are provided on the large uninsulated sides with electrically insulating strips 6 and 7, the strips are provided with solderable metal strips 8 and 9 on top of the electrically insulating strips 6 and 7, each of the metal strips 8 and 9 being electrically conductively connected to one of the electrically conductive layers 2 and 3, and the strips are divided into cuboids.

* * * * *